US007775587B1

(12) United States Patent
Reed

(10) Patent No.: US 7,775,587 B1
(45) Date of Patent: Aug. 17, 2010

(54) SPORT/PAK/CHAIR

(75) Inventor: William Fischer Reed, Nekoosa, WI (US)

(73) Assignee: William F. Reed, Nekoosa, WI (US)

( * ) Notice: Subject to any disclaimer, the term of this patent is extended or adjusted under 35 U.S.C. 154(b) by 377 days.

(21) Appl. No.: 11/729,234

(22) Filed: Mar. 27, 2007

Related U.S. Application Data

(60) Provisional application No. 60/787,986, filed on Mar. 30, 2006.

(51) Int. Cl.
*A47C 4/00* (2006.01)

(52) U.S. Cl. ..... 297/35; 297/16.1; 297/54; 297/129

(58) Field of Classification Search ..... 297/51, 297/54, 35, 32, 129, 16.1
See application file for complete search history.

(56) References Cited

U.S. PATENT DOCUMENTS

| | | | | |
|---|---|---|---|---|
| 3,077,327 | A | | 2/1963 | Batie |
| 4,190,918 | A | | 3/1980 | Harvell |
| 4,676,548 | A | | 6/1987 | Bradbury |
| 4,687,248 | A | | 8/1987 | Ross |
| 4,773,574 | A | | 9/1988 | Burgard |
| 4,889,383 | A | * | 12/1989 | Jones ..... 297/54 |
| 5,297,708 | A | | 3/1994 | Carpenter |
| 5,318,342 | A | | 6/1994 | Hale |
| 5,350,215 | A | * | 9/1994 | DeMars ..... 297/129 |
| 5,409,291 | A | | 4/1995 | Lamb |
| 5,607,089 | A | | 3/1997 | Strum |
| 5,628,437 | A | | 5/1997 | Kober |
| 5,722,717 | A | | 3/1998 | Rettenberger |
| 5,988,737 | A | * | 11/1999 | Tomaiuolo ..... 297/129 |
| 6,250,712 | B1 | | 6/2001 | Livington |
| 6,547,324 | B1 | | 4/2003 | Ammann |

* cited by examiner

*Primary Examiner*—Anthony D Barfield

(57) ABSTRACT

A compact portable chair with attachable combination padded seat and backrest. The chair further includes a backrest framework hingeably joined with the seat framework. A back support framework is rotatable between an upwardly extended position for establishing a backrest and a laid-over position to parallel with the seat framework. Back and front leg support frameworks are hingeably joined to the underside of the seat framework and are rotatable inward and upward to parallel positions with the seat framework. The four legs are individually adjustable by means of a sliding sleeve and button locking system. The compact portable chair is further mountable onto a person's back by means of a detachable pair of shoulder straps connected to the backrest and seat frameworks. The chair further has cup holders included with a pair of armrests that are detachable. A further embodiment includes an attachable backpack.

8 Claims, 20 Drawing Sheets

SPORT/PAK/CHAIR

CROSS-REFERENCE TO RELATED APPLICATION

This application claims the benefits of provisional patent application Ser. No. 60/787,986 filed 2006 Mar. 30 by present inventor.

FEDERAL SPONSORED RESEARCH

Not Applicable

SEQUENCE LISTING OR PROGRAM

Not Applicable

BACKGROUND OF THE INVENTION

1. Field of Invention

This invention relates to a compact, portable chair. Specifically, this invention relates to a chair with individually adjustable legs, armrests, headrest, attachable foam padded foldable seat and backrest, detachable backpack for transporting additional items all part of a foldable compact portable chair.

2. Prior Art

There are many types of portable chairs available and common to the marketplace. There are indoor and outdoor chairs of many different shapes and sizes; some chairs are permanent, others either movable or portable. Some portable chairs can be folded into sections to ease in transporting and storage. Portable chairs do not generally include arm rests and headrests due to the difficulty of folding these elements along with the rest of the chair into an easily portable configuration.

There are also many bags and backpacks available in today's marketplace. Different bags, containers, coolers; and other carrying devices are well known in the art. There are also a wide variety of backpacks available in the marketplace. Some backpacks are available for everyday use, while others are used for hiking and camping.

Due to their mobile nature, portable chairs are often carried with bags and backpacks. For example, when attending outdoor sporting events and outdoor concerts, it is often required that the attendees bring their own chairs. These attendees usually also wish to bring additional materials. Such articles are best carried together in a bag or pack. Unfortunately, it is not easy for a single person to carry both a chair and a pack of food and other articles. It is not easy to transport the folding chairs currently on the market. These chairs are cumbersome to carry and difficult to hold. The weight of the chair is unbalanced when it is in the folded position; and the chair tends to come unfolded during transportation. Carrying a chair becomes doubly difficult if the person is also carrying a bag full of food and other articles. This chore can become nearly impossible if the person is also carrying or attending to a small child.

To solve this problem, inventors have created several portable chairs that include a bag or backpack. Examples of such combinations are disclosed in Rettenberger, U.S. Pat. No. 5,722,717, Kober, U.S. Pat. No. 5,628,437, Lamb et al., U.S. Pat. No. 5,409,291, Hale, U.S. Pat. No. 5,318,342, Bradbury, U.S. Pat. No. 4,676,548, and Batie, U.S. Pat. No. 3,077,327. The majority of these prior art inventions use a folding lawn-chair style chair with a backpack mounted on one of various parts of the chair. These chairs are all extremely cumbersome and difficult to manage; and they are uncomfortable and clumsy in use. Batie and Rettenberger both disclose combination chair and backpacks utilizing a three-frame folding chair similar to the instant invention; however, neither of these chairs mount a backpack on the back of the chair. The structural instability of these designs precludes mounting anything on the back of the chair; and indeed, the chairs are so poorly designed they tend to collapse when there is nobody sitting in the chair. Furthermore, the chairs do not easily convert into a portable configuration, and none of these inventions include a headrest, armrests, attachable foam padded foldable seat with backrest, individually adjustable legs, and detachable carrying harness.

Other prior art inventions include U.S. Pat. No. 4,773,574 to Burgard (1988), which discloses a pack having first and second rectangular frames which are pivotally interconnected to form a chair which folds into a backpack. This invention suffers from several serious disadvantages. First, the pack portion is located on the underside of the seat rather than the back of the chair. Second, the support legs are all of the same length, causing the chair to lack the stability achieved in the present invention. Third, this patent describes what is essentially a two-frame structure that does not fold or lock satisfactorily. U.S. Pat. No. 4,687,248 to Ross and Friedman (1987) discloses a tote-bag with a complex construction that transforms into a chair by a slow complex step-by-step process. This tote-bag is not preferred because of the cumbersome process to achieve portability. U.S. Pat. No. 4,190,918 to Glenn M. Harvell (1978), discloses a simple carry suitcase cushion that folds out into a double cushion. This invention does not allow any amenities to be transported inside and only provides a cushion that must be used atop of an existing chair or bench. U.S. Pat. No. 4,676,548 to Patrick H. Bradbury (1987) discloses a bulky and uncomfortable lawn chair with a pack on the back.

U.S. Pat. No. 6,457,324 B1 to Leslie G. Ammann, Jr. discloses a folding chair with a backpack; however, the backpack is not removable making it not easily accessible from a seated position. The height adjustment for the chair does not allow for placing the chair on an uneven surface. The seating is not comfortable for sitting for long periods of time. This prior art does not exhibit a compact portable chair with individually adjustable legs that make it possible to adjust the height of the chair and also allows leveling of the seating platform that compensates for surfaces that are not level. This invention fulfills these needs and provides further advantages as described in the following summary of objects and advantages.

OBJECTS AND ADVANTAGES

The present invention's main object provides a compact portable chair for use in the outdoor field, but not limited to the following usage; hunting, fishing hiking, picnicking, parades, concerts, home and various other activities. This main embodiment provides a means of folding the backrest support frame hingeably joined to the back of the seat support frame to rotate to a flat position parallel with the seat support frame. The backrest in the upright position is locked by means of a sliding sleeve and a 90° elbow joint. In similar fashion the front and rear leg support frames are hingeably joined with 90° elbow joints to allow folding first, the rear leg frame and then the front leg frame to provide a flat and parallel position to the underside of the support seat frame. The front and rear seat frames are locked in the open chair leg position by a pair of folding stabilizer tubes, 180° bending elbow and a sliding stabilizer sleeve.

This embodiment provides a compact portable chair having advantages not presented by prior art.

Another embodiment provides individually adjustable legs which adjust to the surface terrain. This allows the chair to be leveled on uneven ground locations and also to adjust the height of the chair to conform to a person's leg length for comfortable seating.

Additional embodiment provides a detachable backpack which allows convenient placement of the backpack and its contents within reach while still seated. This is an important feature while hunting. Many forms of hunting such as deer and wild turkey require minimal movement.

Another embodiment provides a foam padded foldable seat and backrest. This is attached to the top of the backrest frame by means of a swivel spring clip to allow this combined seating and back support to be removed if required, but also this unit flips over the top of the backrest frame.

This unit then forms a cushion between a person's back and the chair adding comfort while transporting the compact portable chair. The seating unit, in addition to the comfort of the padding, has a center filled with a material when compressed produces heat for comfort in cold weather use.

An additional embodiment provides for a detachable carrying harness. The advantage of it being detachable allows its separate use with a strap or rope for transporting wild game such as deer, or for dragging sleds, wagons or other transporting conveyances.

The material used to form the seat, backrest, and padded detachable cushion is preferably made of a durable, water resistant, camouflage cloth. A blaze-orange material is attachable to the back of the chair or backpack. This feature is used as a safety factor when required for hunting.

Other features and advantages of the present invention will become apparent from the following more detailed descriptions, taken in conjunction with the accompanying drawings which illustrate, by way of example, the principles of the invention.

SUMMARY

The present invention comprises a foldable, compact portable chair, individually adjustable legs, backrest with headrest, armrests, separate attachable padded seat and backrest and detachable carrying harness with backpack attachment.

In the drawings, closely related figures have the same number but different alphabetic suffixes.

DRAWINGS

Figures

Figure 23:
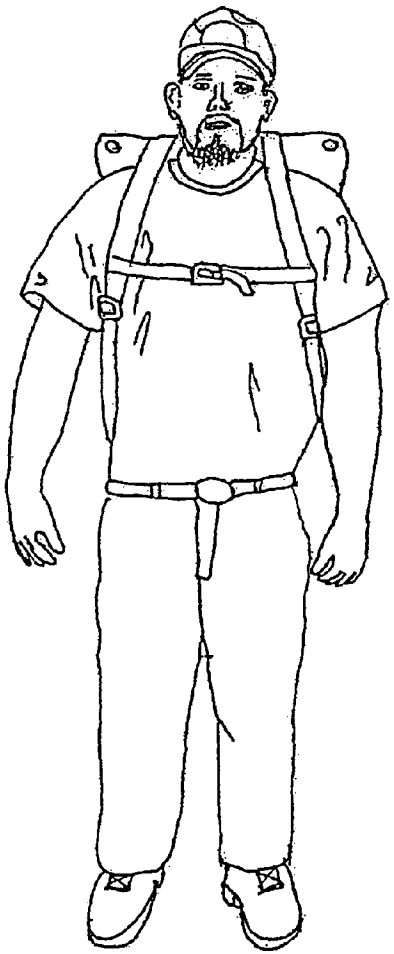

FIG. 23 front view shows method of carrying folded chair.

Figure 24:
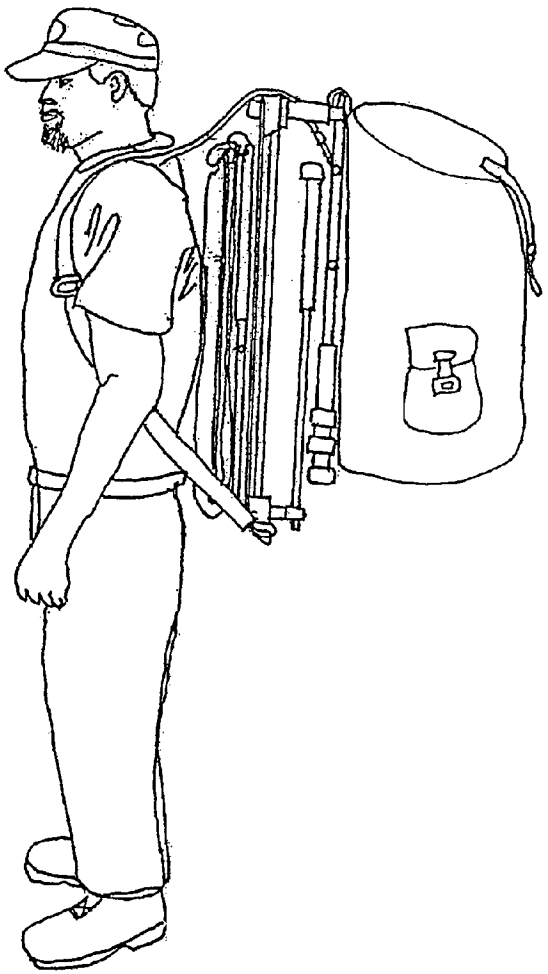

FIG. 24 side view shows method of carrying folded chair with backpack attached.

DRAWINGS

Reference Numerals

| | |
|---|---|
| 30 | front and rear stabilizer tubes |
| 31 | chair with water resistant cloth cover |
| 32 | large "D" ring |
| 33 | attachable cushioned seat and backrest |
| 34 | small "D" ring |
| 35 | backrest framework |
| 36 | backrest tube |
| 37 | rear leg framework |
| 38 | back seat tube |
| 39 | front leg framework |
| 41 | seat framework |
| 42 | side seat tube |
| 44 | lower back folding leg tubes |
| 46 | front folding leg tubes |
| 48 | backrest sleeve |
| 50 | upper back folding leg tubes |
| 52 | upper front folding leg tubes |
| 54 | adjustable leg sleeve |
| 56 | female buckle with strap |
| 58 | connector block |
| 60 | front seat |
| 62 | foot cap |
| 64 | backrest protector cap |
| 66 | armrest protector |
| 68 | removable armrest |
| 70 | 90° knee joint |
| 70a | 90° male elbow |
| 70b | 90° female elbow |
| 70c | 90° male elbow with groove |
| 70d | 90° female elbow with groove |
| 72 | female buckle with strap retainer |
| 74 | male buckle with strap retainer |
| 76 | lock stabilizer block |
| 78 | front stabilizer block |
| 80 | mid stabilizer block |

-continued

| | |
|---|---|
| 82 | folding stabilizer tube |
| 84 | sliding stabilizer sleeve |
| 86 | grommet |
| 88 | cushion insert with heat producing material |
| 90 | seat foam |
| 92 | backrest foam |
| 94 | swivel spring clip |
| 96 | 180° bending elbow |
| 96a | 180° male elbow |
| 96b | 180° female elbow |
| 98 | swivel spring clip |
| 100 | tension pin |
| 102 | button |
| 104 | button spring |
| 106 | solid ring |
| 108 | padded adjustable strap |
| 110 | stabilizer adjustable strap |
| 112 | female buckle |
| 114 | male buckle |
| 116 | sliding strap retainer |
| 118 | permanent strap retainer |
| 120 | detachable shoulder harness for chair |
| 122 | backpack with carrying straps |
| 124 | double male 90° elbow |
| 126 | stop pin |

DETAILED DESCRIPTION OF PREFERRED EMBODIMENTS

Figure 1:
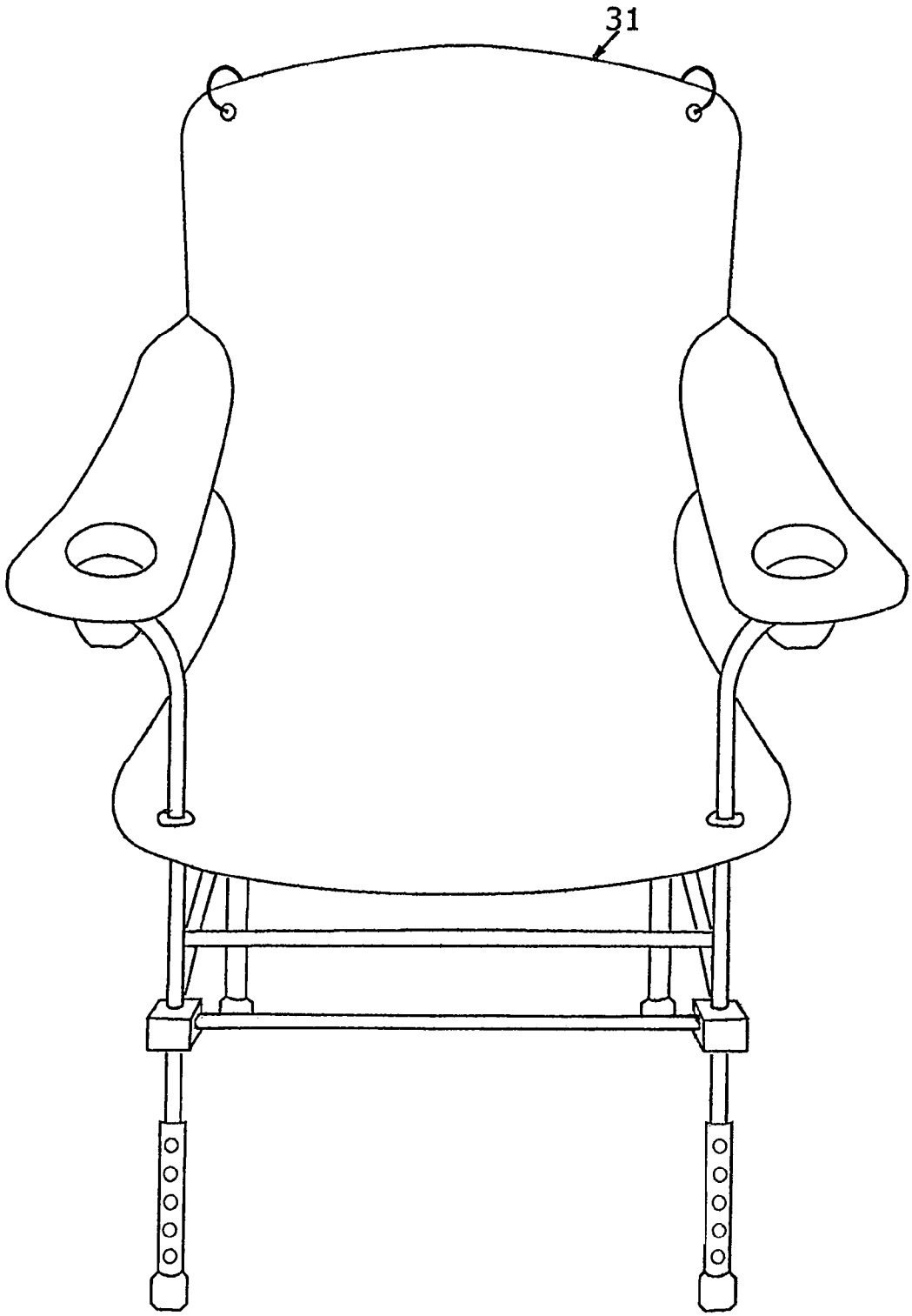
FIG. 1 shows a perspective view of the chair.
Figure 2:
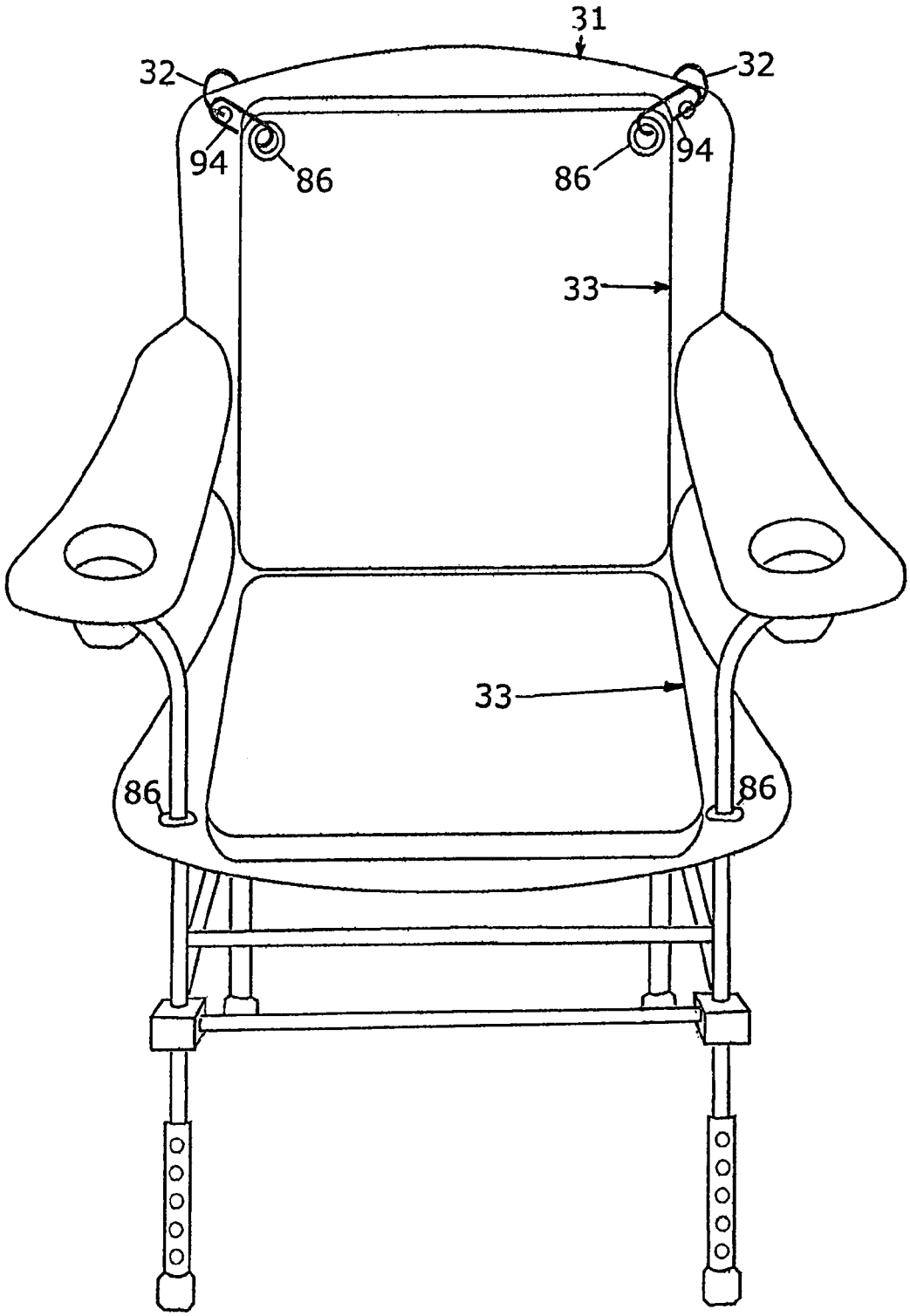
FIG. 2 shows a perspective view of the chair including the combined padded seat and backrest.

A preferred embodiment of the compact portable chair 31 of the present invention is illustrated in FIG. 1 in an open front perspective view. FIG. 2 shows chair 31 with attachable cushioned seat and backrest 33. The preferred means of attachment uses swivel spring clips 94 snapped through grommets 86. Other style attachments can be used such as carabiners. The seat section of 33 has a removable insert 88 with heat producing material as used in products sold under names as Hot Seat or Thermo Seat. Insert 88 is used for warmth in cold conditions. This insert 88 is removable from the seat 33 by means of an opening in the underside of the seat. Insert 88 can be replaced with same size foam 90 during warmer conditions. The type of material used in foam 90 is generally used for seating material in the furniture industry. The above provides comfort during different climatic conditions. The preferred means of closing the opening of insert 88 is with the use of Velcro or other alternative methods such as a zipper, envelope fold or other closures. The backrest is filled with foam 92. Same type as foam 90. The preferred thickness of the seat is more than the backrest section but can be the same.

Figure 4:
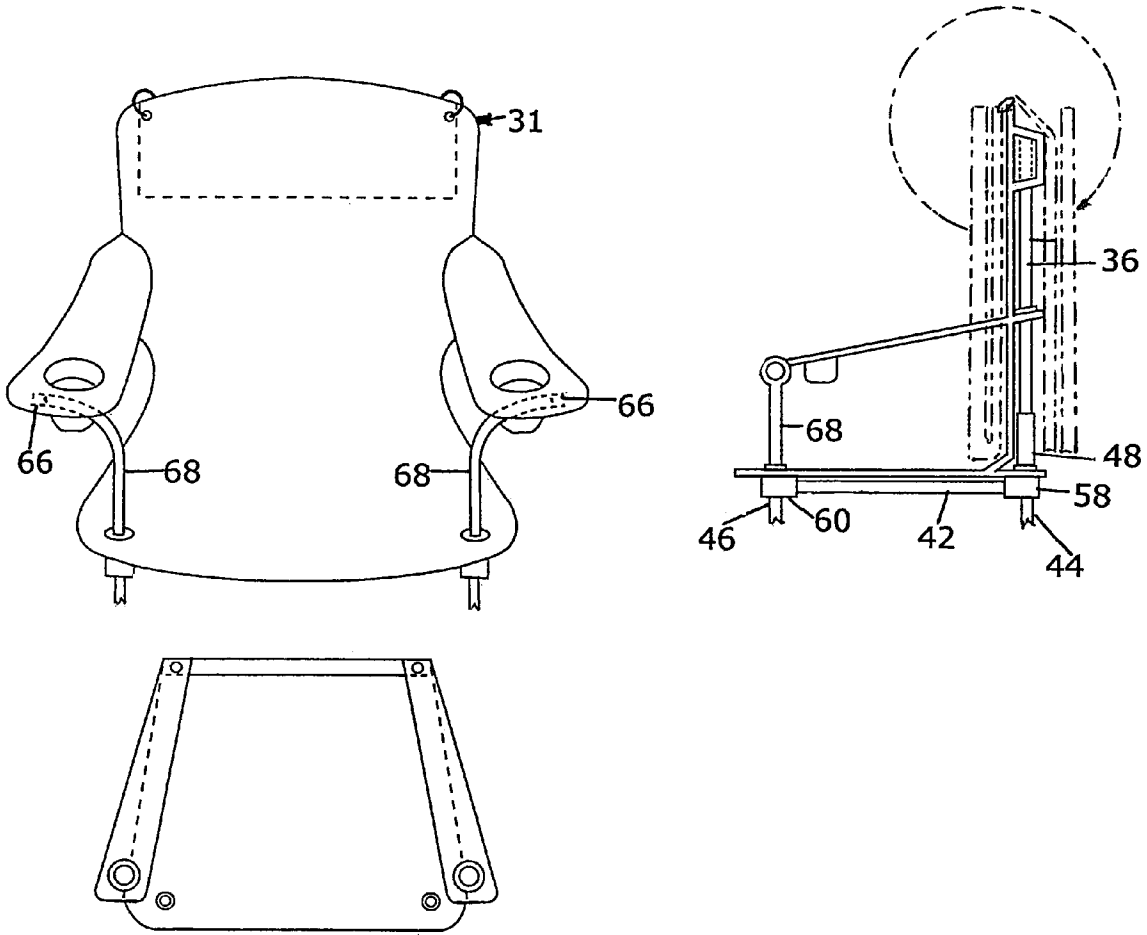
FIG. 4 shows a partial frontal and side view with framework in seating position and a folded view.
Figure 5:
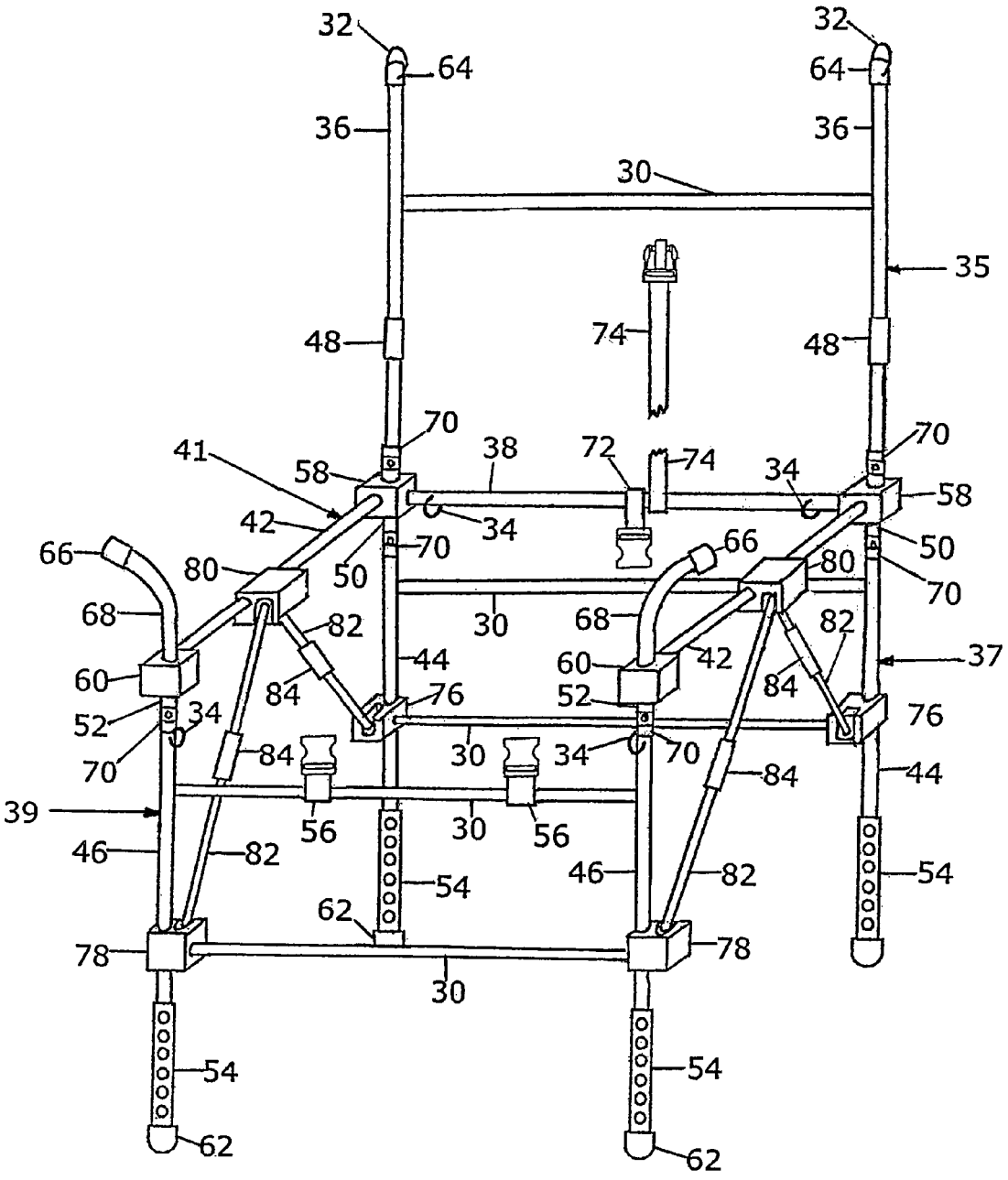
FIG. 5 shows the structural framework of the chair.

FIGS. 4 and 5 embodiments comprise the framework of chair 31. FIG. 5 shows attached "D" rings 32 located on top of backrest tube 36. "D" rings 34 are located on backseat tube 38 and front folding legs tubes 46. "D" rings 32 provides a means for attachment of seat and backrest 33. Rear stabilizer tube 30 is connected to backrest tubes 36 to form an "H" shaped backrest framework 35. FIG. 5 further illustrates the seat framework 41 which is comprised of side tubes 42 (right and left) front seat connector blocks 60, back seat connector blocks 58, mid seat connector blocks 80 and back seat tube 38 which forms a "U" shaped framework. The front leg framework 39 is rectangular shaped. It is comprised of front stabilizer tubes 30, front leg tubes 46, 90° knee joints 70, upper front folding leg tubes 52, front seat connector blocks 60 and front stabilizer blocks 78. The rear leg framework 37 is rectangular shaped. It is comprised of rear stabilizer tubes 30, rear folding leg tubes 44, 90° joints 70, upper rear folding leg tubes 50, back seat connector blocks 58 and back stabilizer blocks 76. Each of the four legs has an adjustable leg sleeve 54 which includes button 102 and button spring 104. Strap with female buckle 72 and strap with male buckle 74 provides a means for retaining the folded chair 31 as a compact unit. Female buckles 56 are further attached to front stabilizer tube 30 which allows a connection with the top end of the shoulder strap harness 120 and its male buckles 114 shown in FIG. 21.

Figure 6:
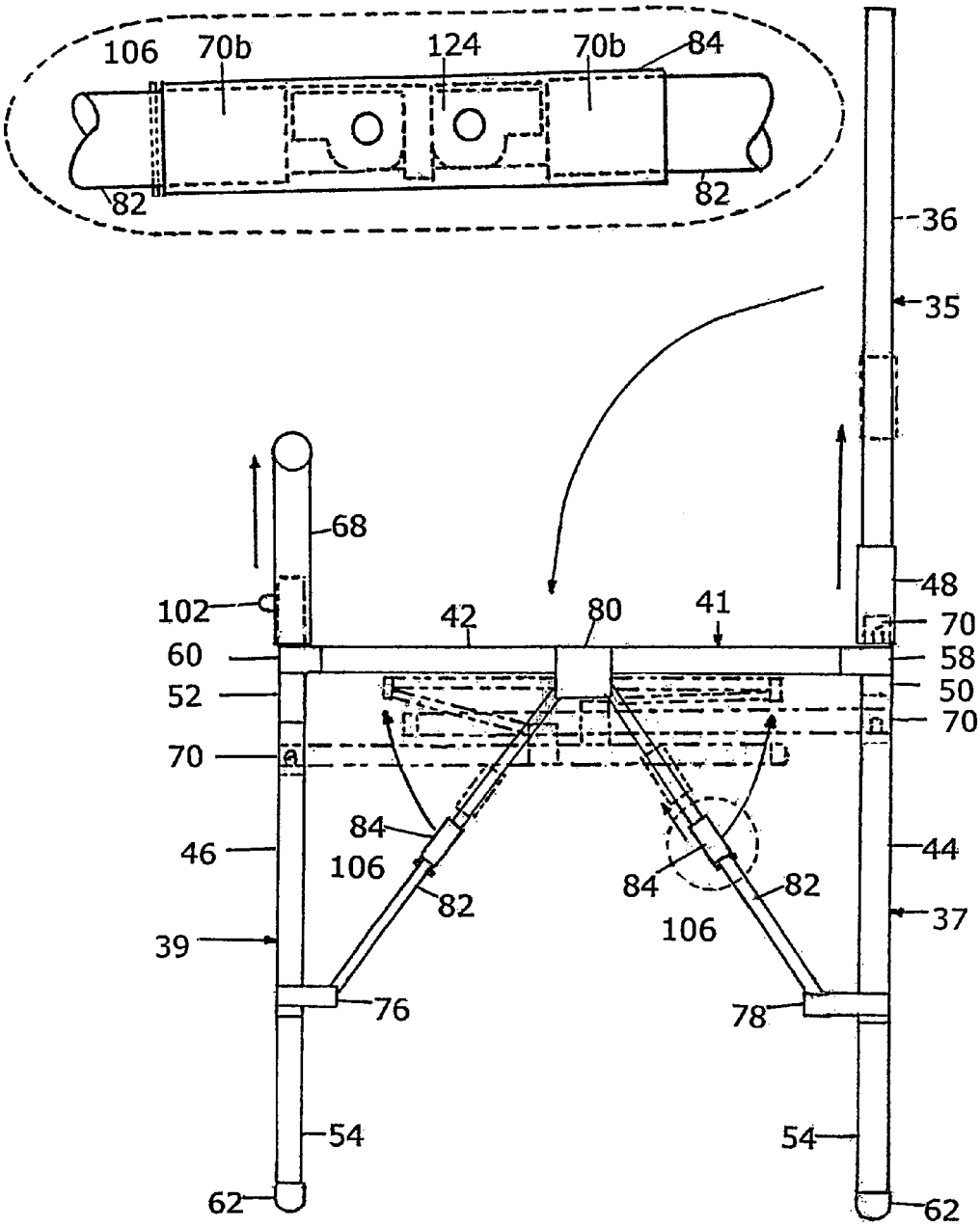
FIG. 6 shows the side view of the structural framework, the mechanics of the folding of the backrest and legs, and the removable or repositionable armrests.

FIG. 6 illustrates the backrest framework 35, front framework 39 and back framework 37 with blocks 58, 60, 76, 78, mid stabilizer block 80 and elbows 70. Connected to the above are folding tubes 82 and sliding stabilizer sleeves 84 with stop pin 126. The insert section provides a view of the means of folding the leg frameworks 37 and 39. It further illustrates a hingable joint comprised of a double male 90° elbow 124 and female elbows **70*b* stabilized with sleeve 84 with stop pin 126. It further illustrates the folding feature of backrest framework 35. This is comprised of framework 35, backrest sleeves 48 and knee joints 70**.

FIG. 6 further illustrates the ability to remove armrests 68. Upper back folding leg 50 extends through connector block 58 and is attached to male elbow joint **70*b* by means of a tension pin 100. This elbow combination forms folding knee joint 70. Knee joint 70 is attached to leg framework 37. This combination allows framework 37 to fold inward and upward parallel with seat framework 41. In similar manor, front leg framework 39 is connected to a knee joint 70, upper front leg tubes 50 and front seat block 60. This combination similarly allows framework 39 to fold inward and upward parallel to folded rear leg framework 37 and seat framework 41. The section of back leg tube 50 which extends through rear seat block 58 is further connected to a knee joint 70. Backrest framework 35 is connected on the top side of knee joint 70. This will allow framework 35 to fold downward and parallel to seat framework 41. FIG. 6 further illustrates the method of removing or repositioning armrest 68. This is accomplished by depressing button 102 and pulling armrest 68 upward. To reposition, button 102 is depressed and held while rotation to a different position and releasing button 102. The new position is locked in place through means of different positioned holes in armrest 68**. There are three holes on the same plane that are located 90° from each other.

Figure 7:
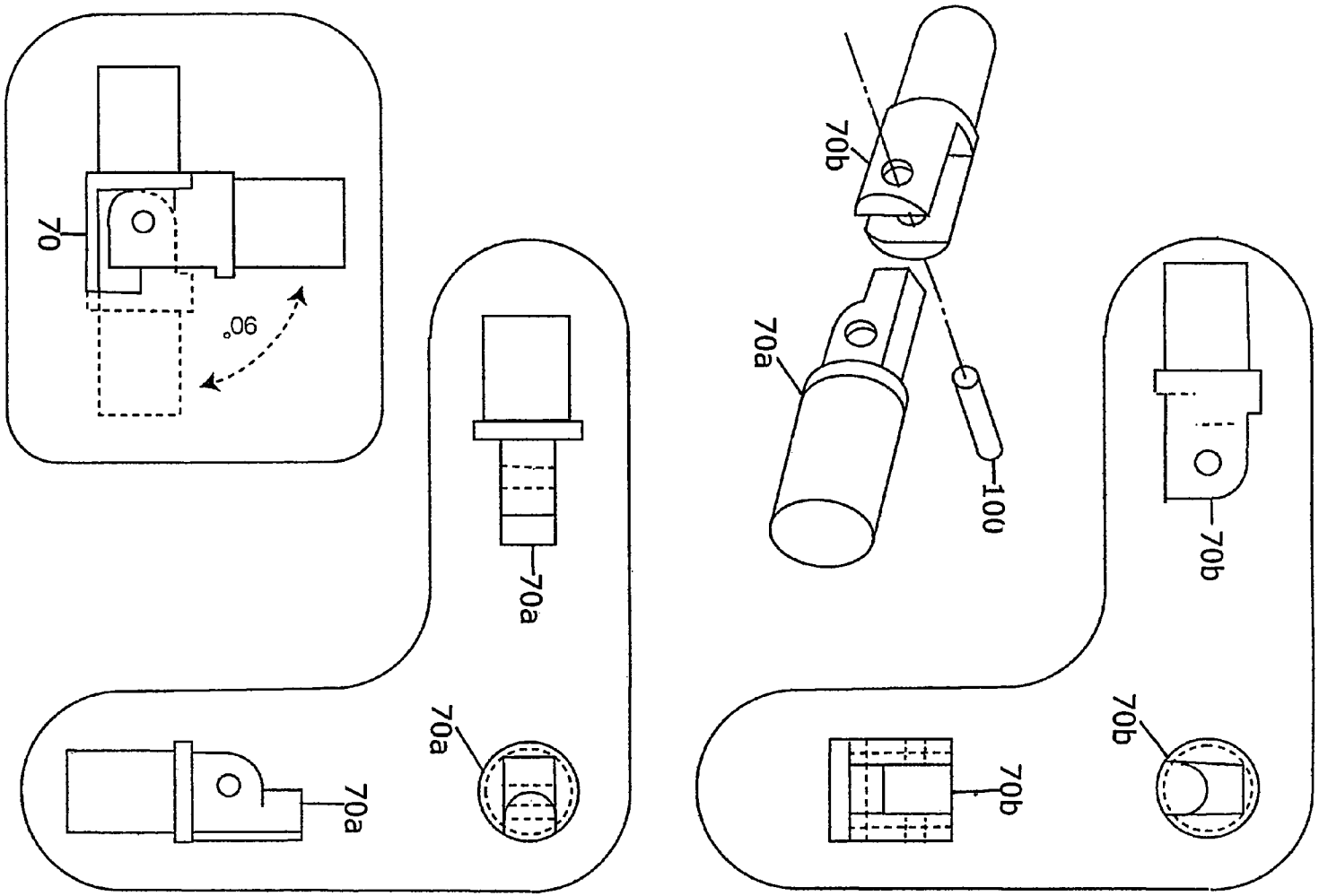
FIG. 7 is a schematic view of the 90° elbow male and female parts with perspective view.
Figure 8:
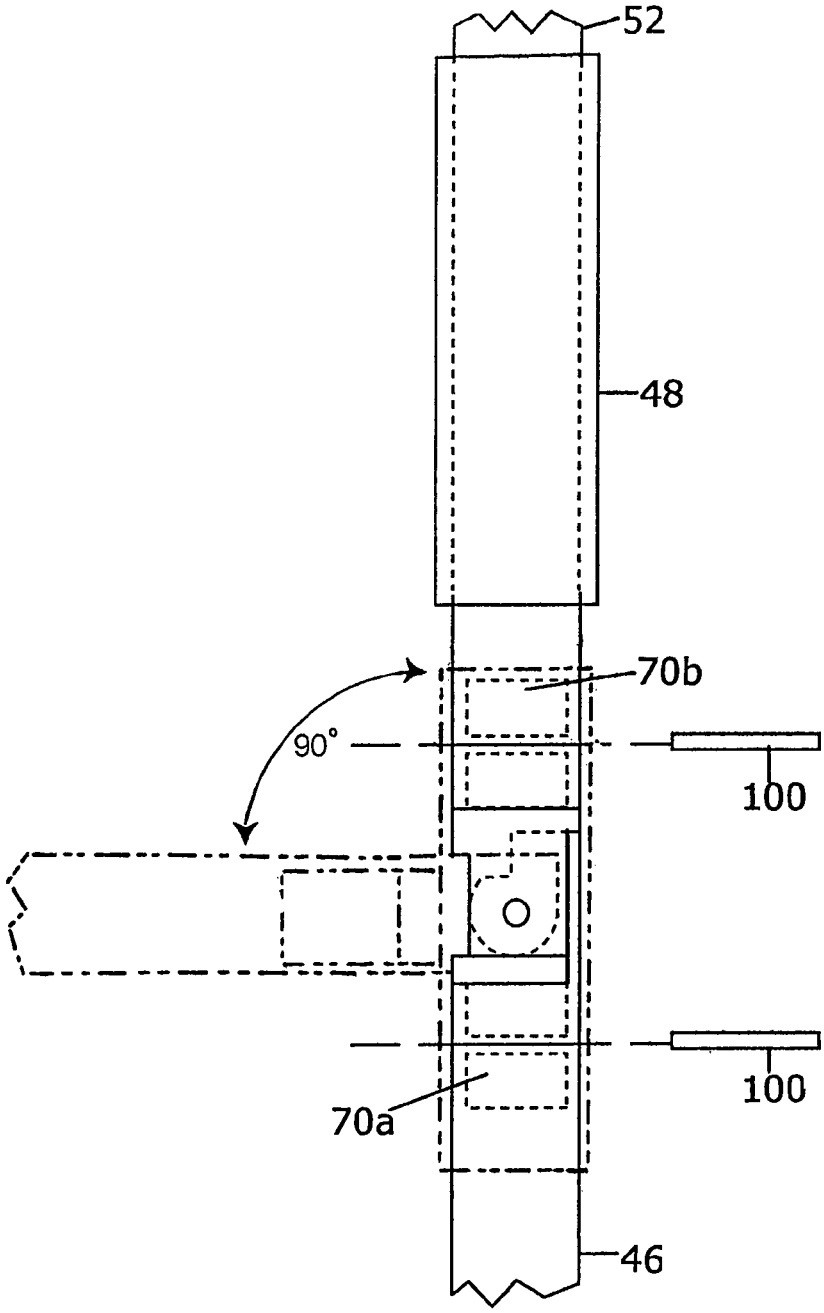
FIG. 8 is a schematic showing the attachment to the tubular supports and its rotation.

FIGS. 7 and 8 illustrates the mechanics of folding knee joint 70. As shown in the perspective view the male elbow **70*a* is attached to female elbow 70*b* by means of tension pin 100. The combination rotates from 180° position to 90°. It is stopped in a 90° position by means of the shoulder on 70*a* and indented section on 70*b*. It is stopped in a 180° position by means of the protrusion of the male elbow 70*a* and the groove in female elbow 70*b*. This is further illustrated in FIG. 8. FIG. 8 illustrates the method of locking knee joint 70 used for maintaining backrest framework 35 in an upright position. Sleeve 48 slides over knee joint 70 in a 180° position thereby locking joint 70** in this position.

Figure 9:
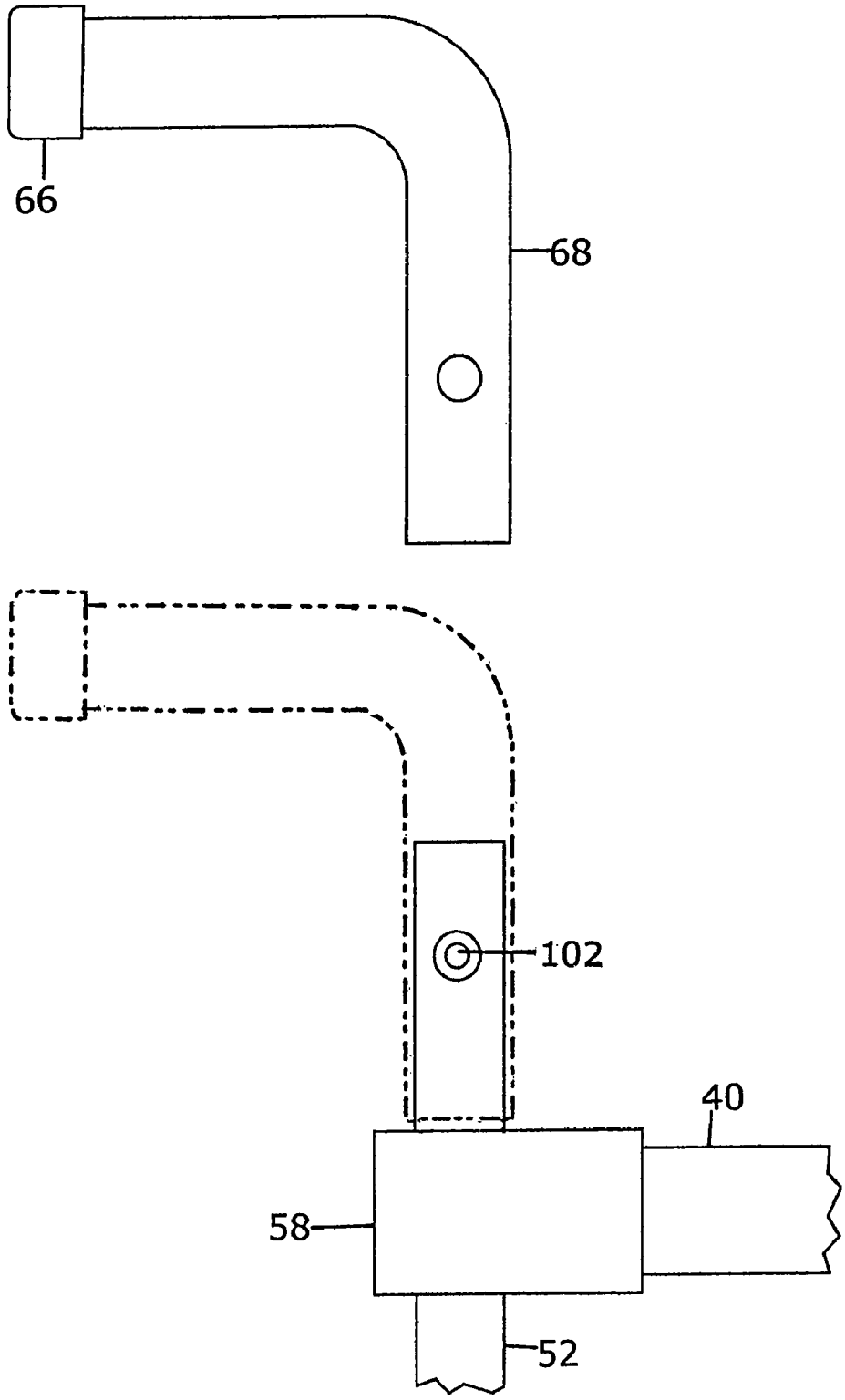
FIG. 9 is a schematic of the removable armrest.

FIG. 9 further illustrates the method of removing or repositioning previously described with embodiments under FIG. 6.

Figure 10:
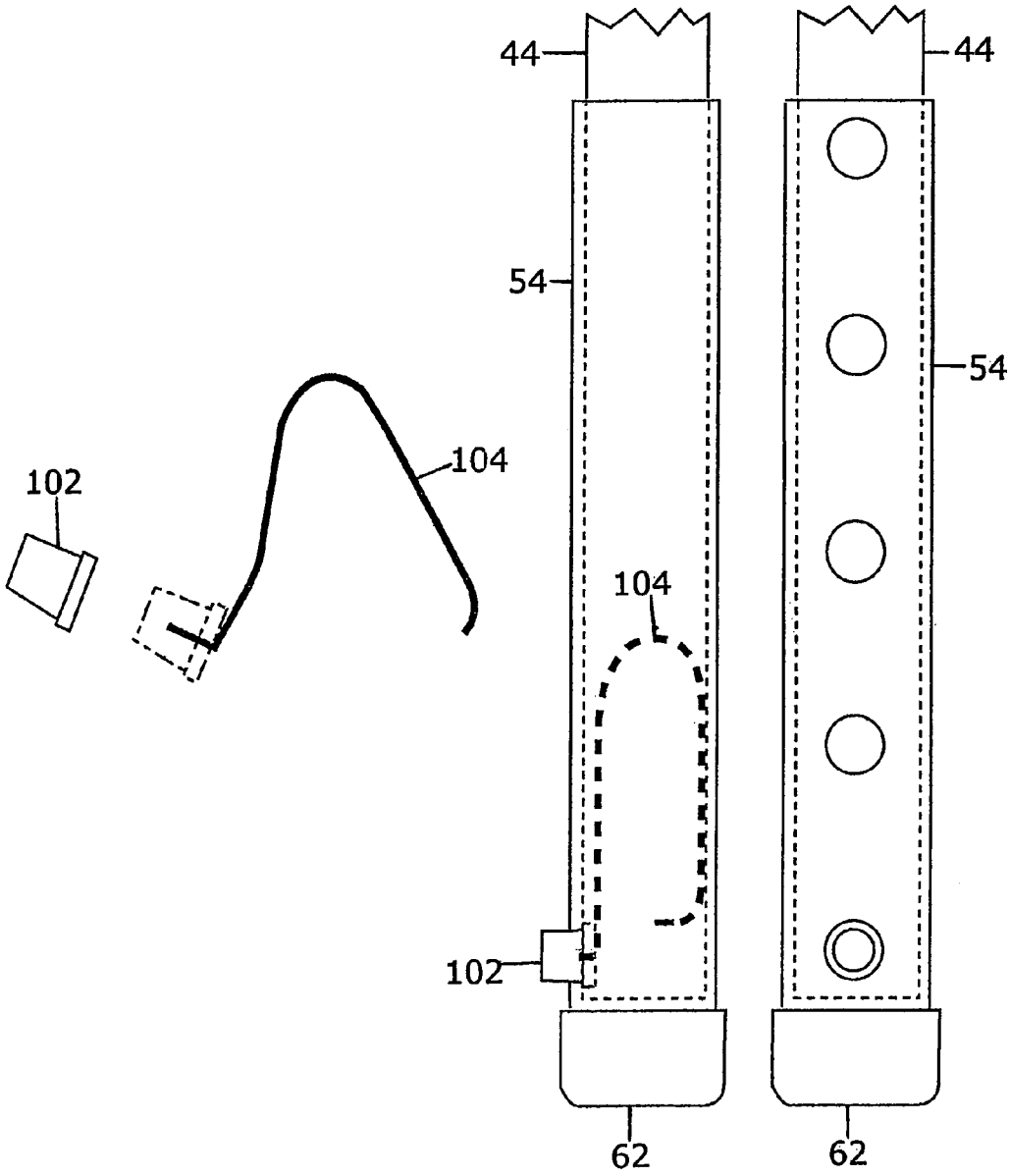
FIG. 10 is a schematic of the adjustable leg, sleeve, spring and button retainer.
Figure 11:
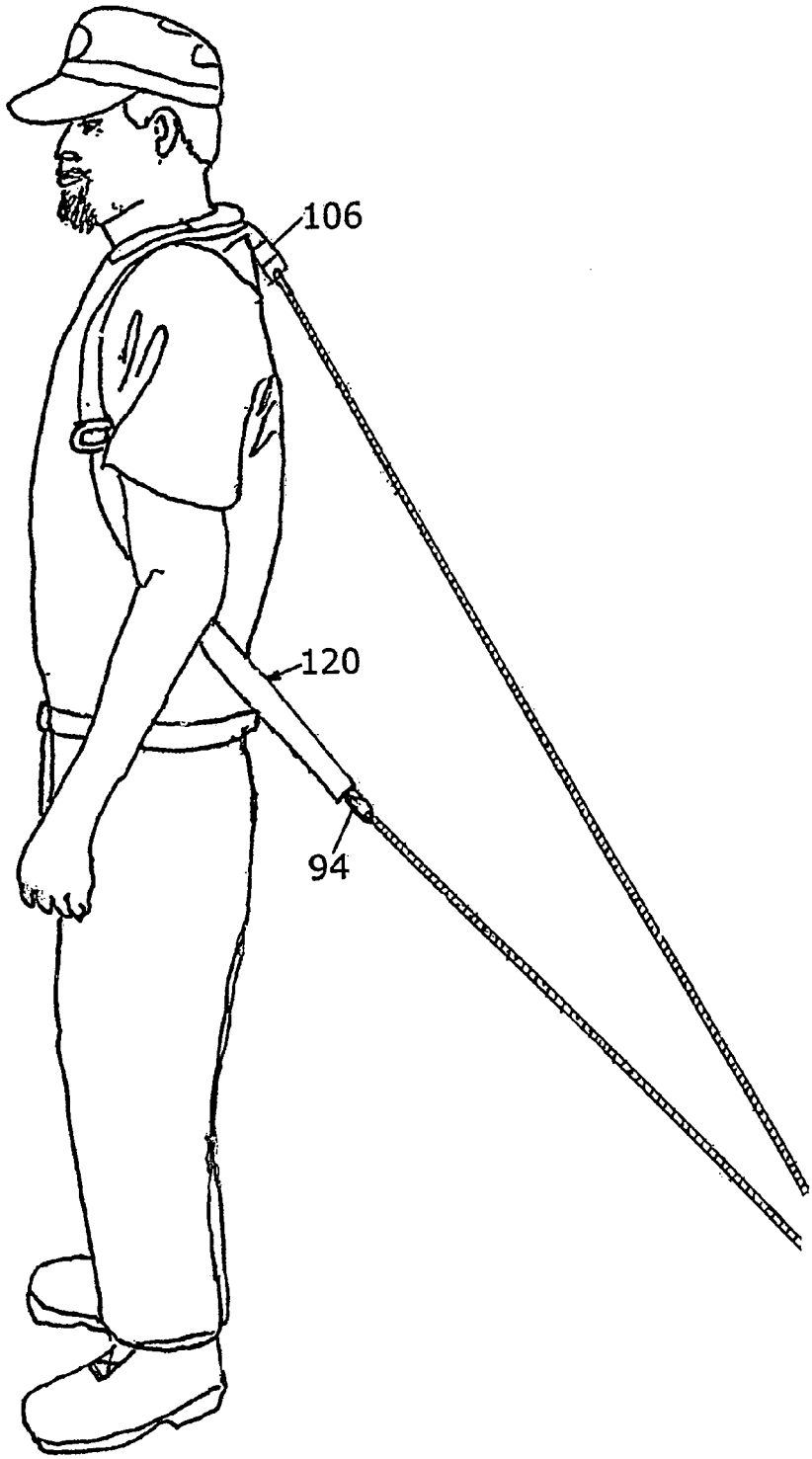
FIG. 11 shows a method for attaching the removable shoulder harness used to drag deer, sled or other product.

FIG. 10 illustrates the method of adjusting each individual leg in preferably one inch increments. Other increments of adjustments can be used. By depressing button 102 into leg sleeve 54, the sleeve which has holes at measured increments can be moved up or down to a new hole position over button 102. Releasing button 102 will lock the new position in place. FIG. 11 illustrates the use of the detachable shoulder harness 120. As shown, attaching a rope or strap to ring 106 and swivel spring clips 94 the other ends of the rope can be attached to an object such as a deer, sled, cart or other load as desired.

Figure 12:
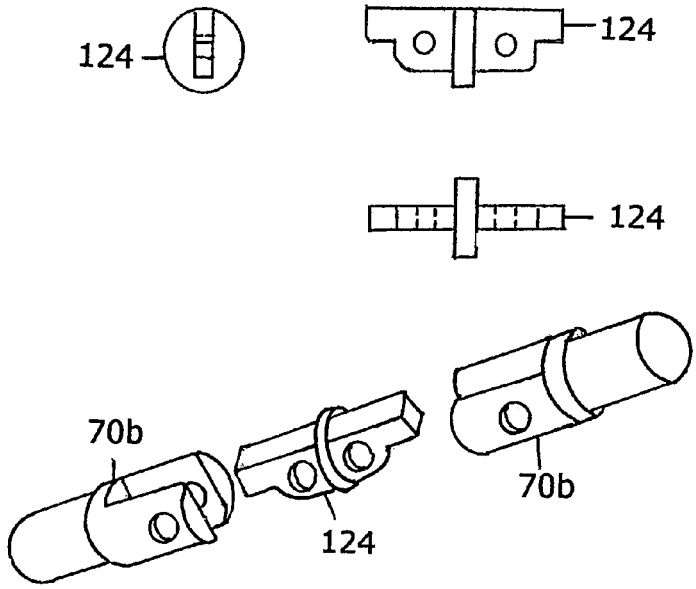
FIG. 12 shows end, side, top and perspective views of the 90° double bending elbow.

FIG. 12 illustrates the elbow mechanism consisting of two female elbows 70*b* and one double male elbow 124 used to fold leg frameworks 37 and 39 through means of stabilizer tubes 82 and stabilizer sleeves 84. This was previously illustrated in FIG. 6.

Figure 13:
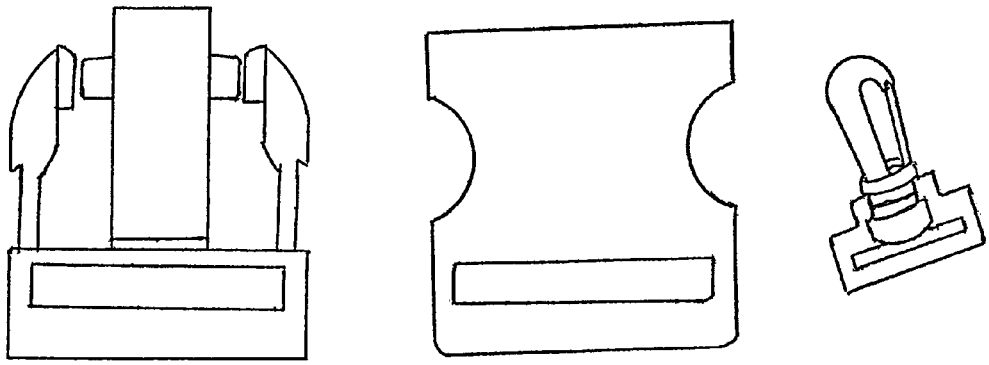
FIG. 13 shows typical male and female buckle components and spring clip.

FIG. 13 illustrates typical buckle and spring clip devices used for connections on various straps.

Figure 14:
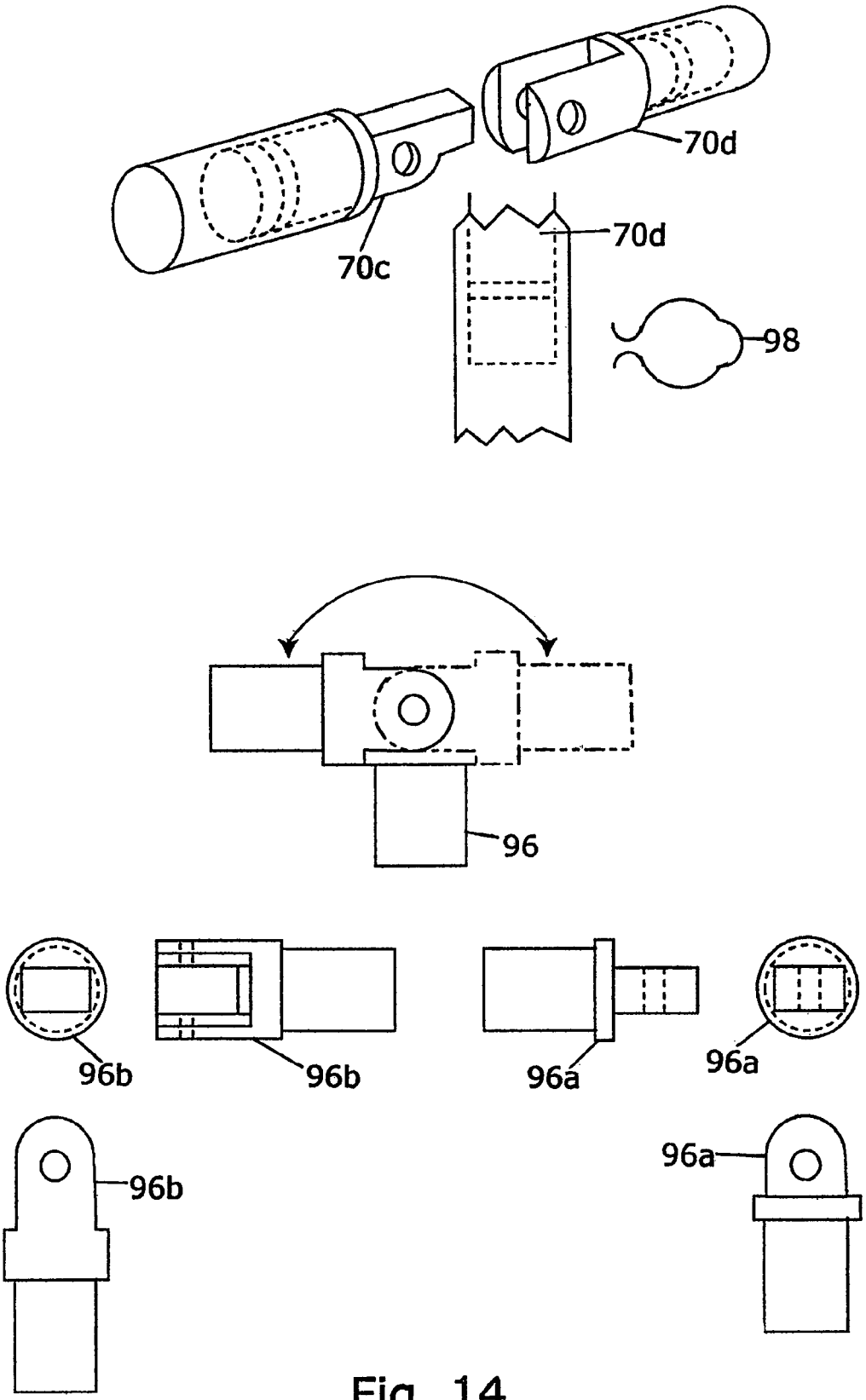
FIG. 14 shows top, side, and end views and a perspective view of a 180° bending elbow with spring clip retainer.

FIG. 14 illustrates another method for using an elbow joint that can be rotated 180°. It also shows an alternative method of the connection with tubing used for support structures. A spring clip locks in the aligning grooves in the tube and the male 70*c* and female 70*d* elbow parts. This elbow 96 is used for additional attachments to chair 31.

Figure 15:
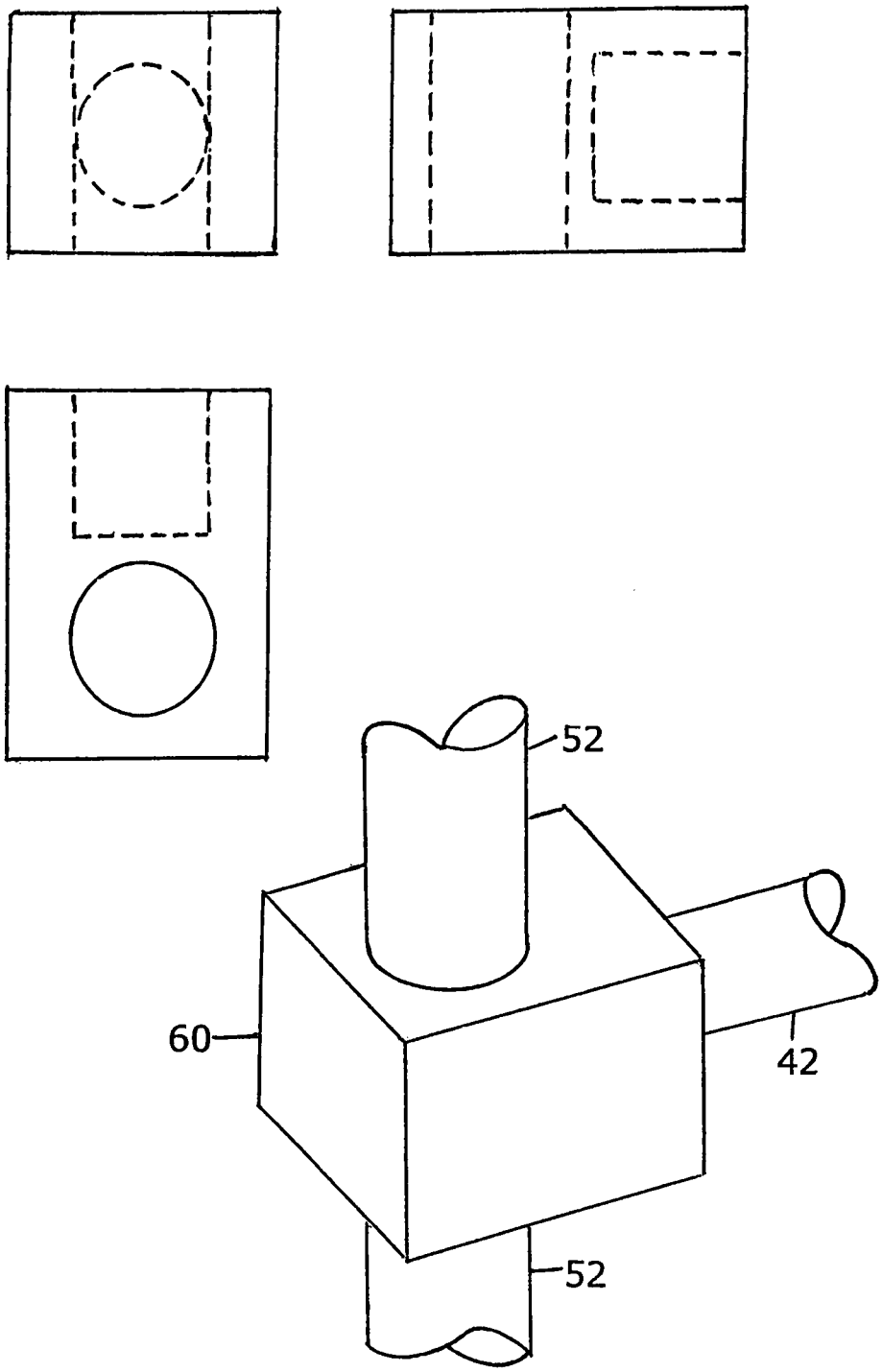
FIG. 15 shows top, side and front views and perspective view of front seat connector block.

FIG. 15 illustrates the connection method of the armrest 68, side seat tube 42, folding leg tube 52 and front seat block 60. Right and left blocks 60 are interchangeable.

Figure 16:
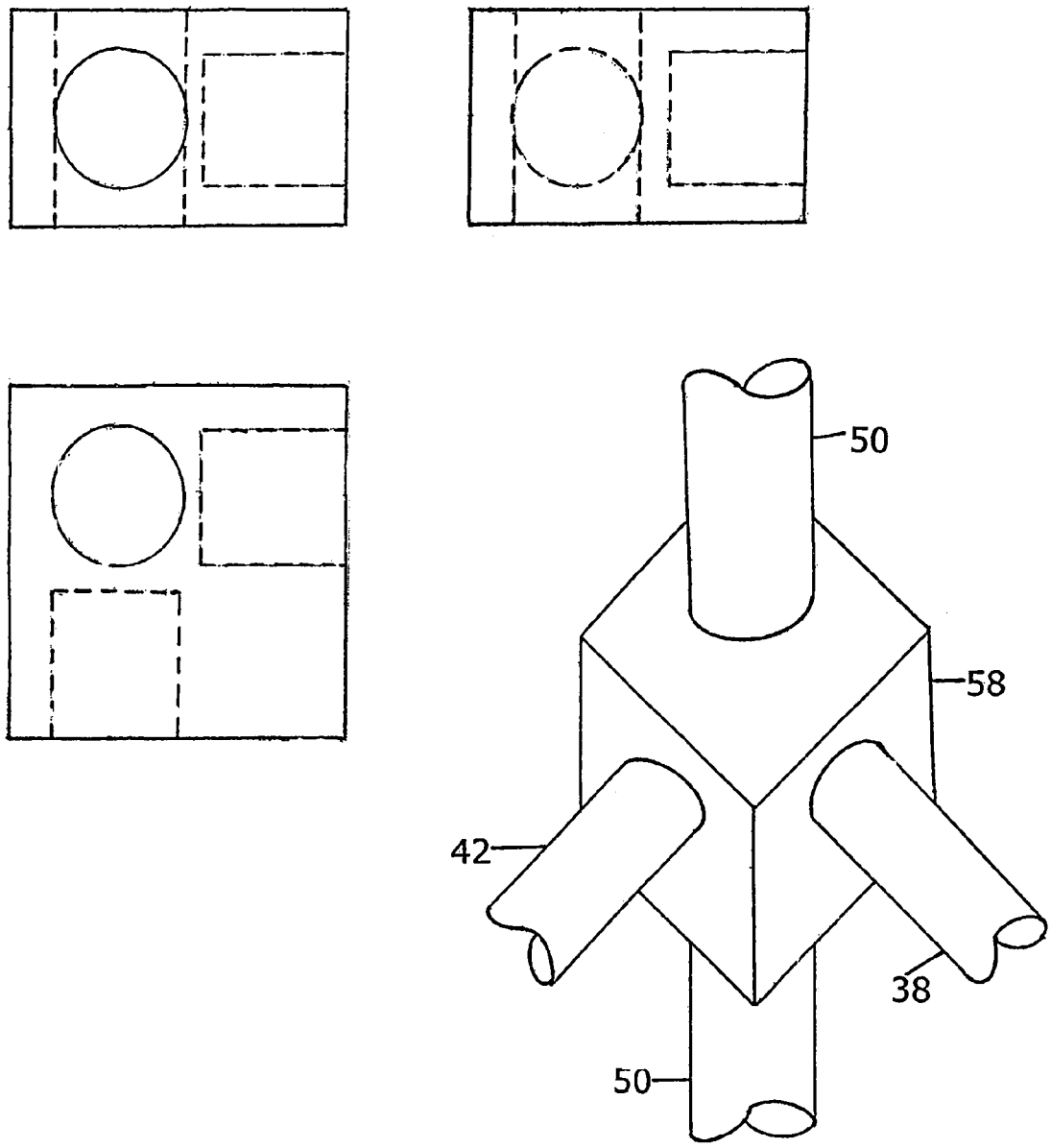
FIG. 16 shows top side and front views and perspective view of back seat connector block.

FIG. 16 illustrates the connection method of tube 42, folding leg tube 50, backrest seat tube 38 and back seat blocks 58. Right and left blocks 58 are interchangeable.

Figure 17:
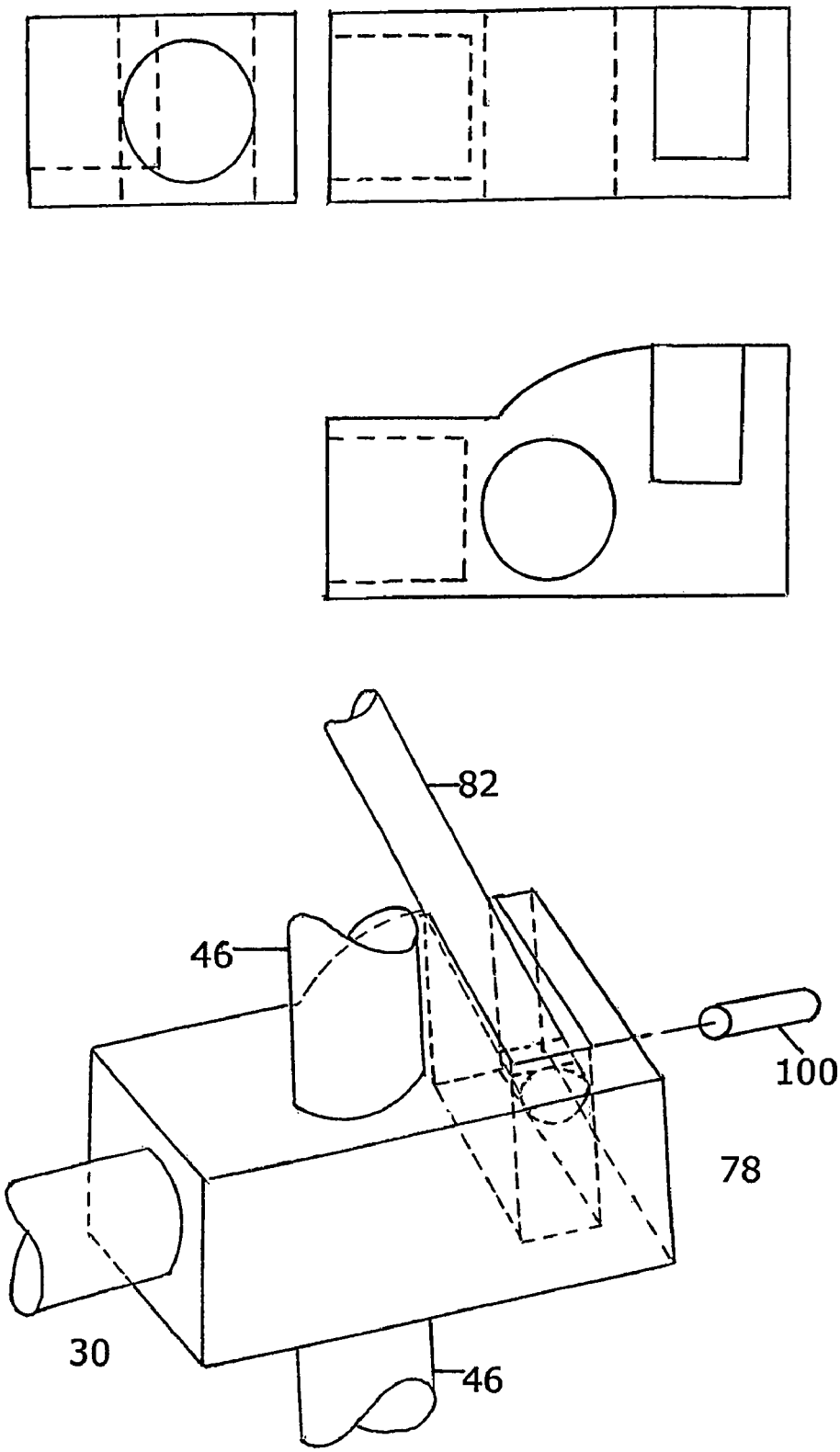
FIG. 17 shows top, side and front views and perspective view of front stabilizer block.

FIG. 17 illustrates the connection of block 78 with rear stabilizer tube 30, front leg tubes 46 and stabilizer tube 82. Tube 82 rotates on tension pin 100 to allow a folding method discussed in FIG. 6. The right block 78 is a mirror image of left block 78.

Figure 18:
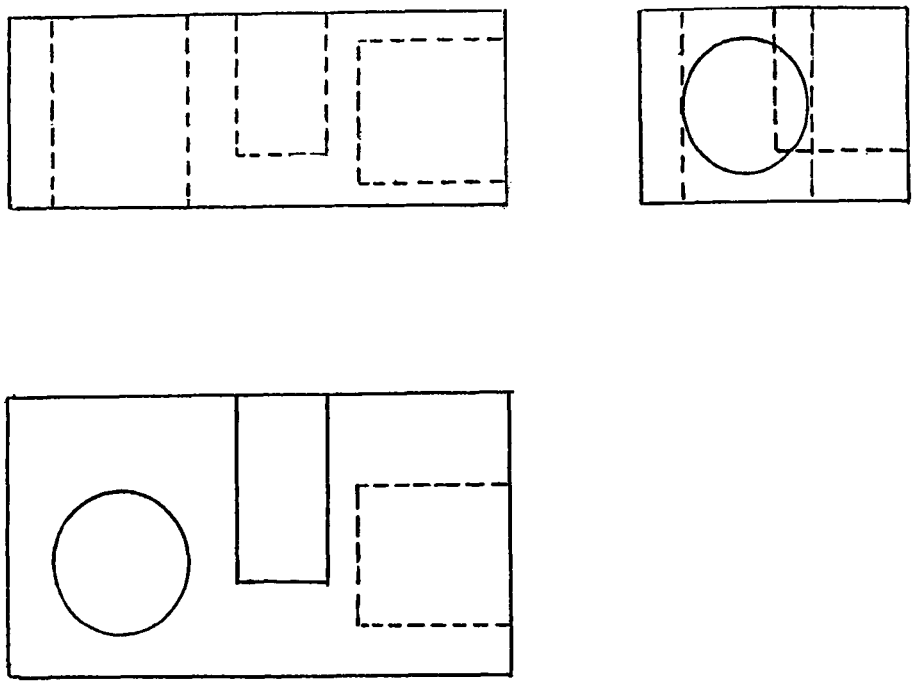
FIG. 18 shows top, side and front views and perspective view of rear stabilizer block.
Figure 18:
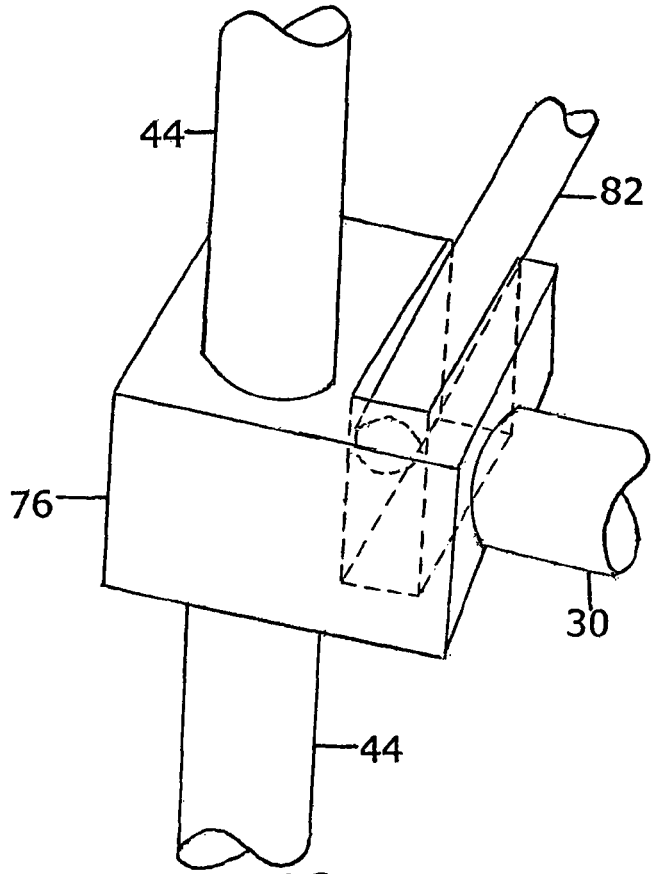

FIG. 18 illustrates the connections of block 76 with tube 30, rear leg tube 44 and stabilizer tube 82. Tube 82 rotates in similar manner described in FIG. 17 using tension pin 100 not shown. Right block 76 is a mirror image of left block 76.

Figure 19:
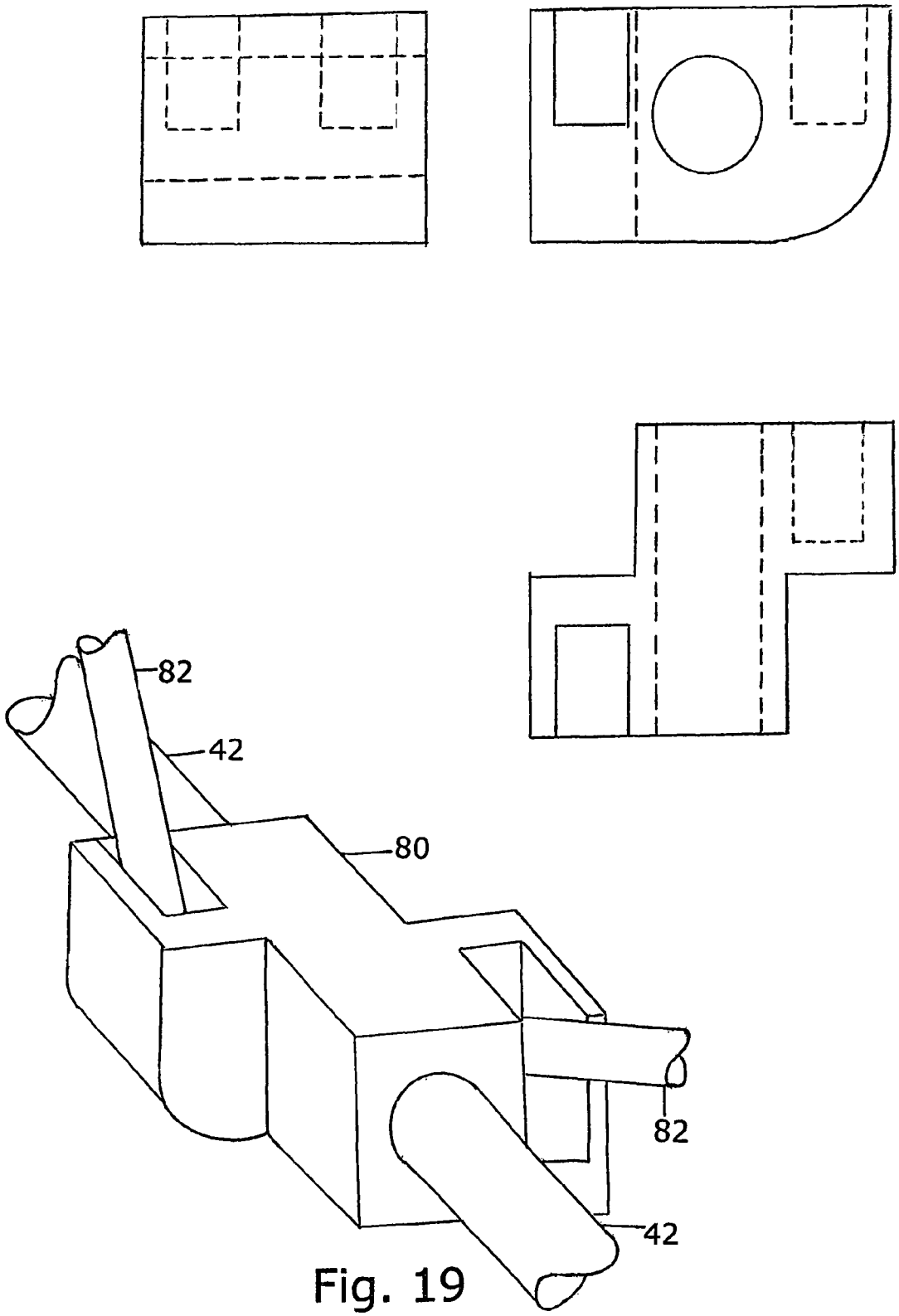
FIG. 19 shows top, side and front views and perspective view of mid stabilizer block.

FIG. 19 illustrates connections of mid block 80 with seat tube 42, and stabilizer tubes 82. Tubes 82 use the same rotation method described in FIGS. 17 and 18. Tension pin 100 is not shown.

Figure 20:
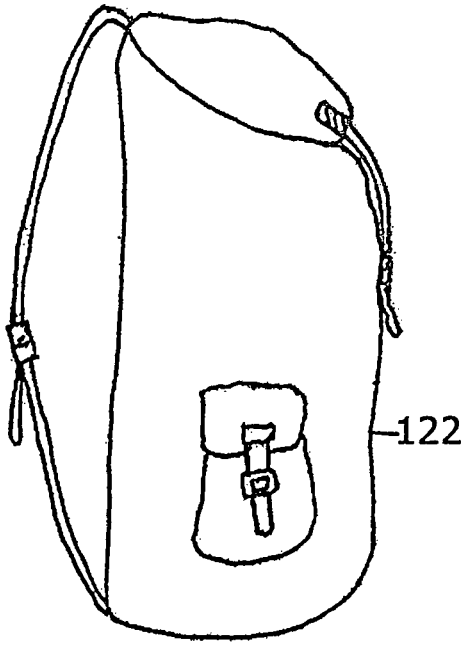
FIG. 20 shows view of typical backpack.

FIG. 20 illustrates a typical backpack. Although backpack 122 is part of this embodiment any backpack or apparatus used for carrying items can be attached in similar manner to be described later.

Figure 21:
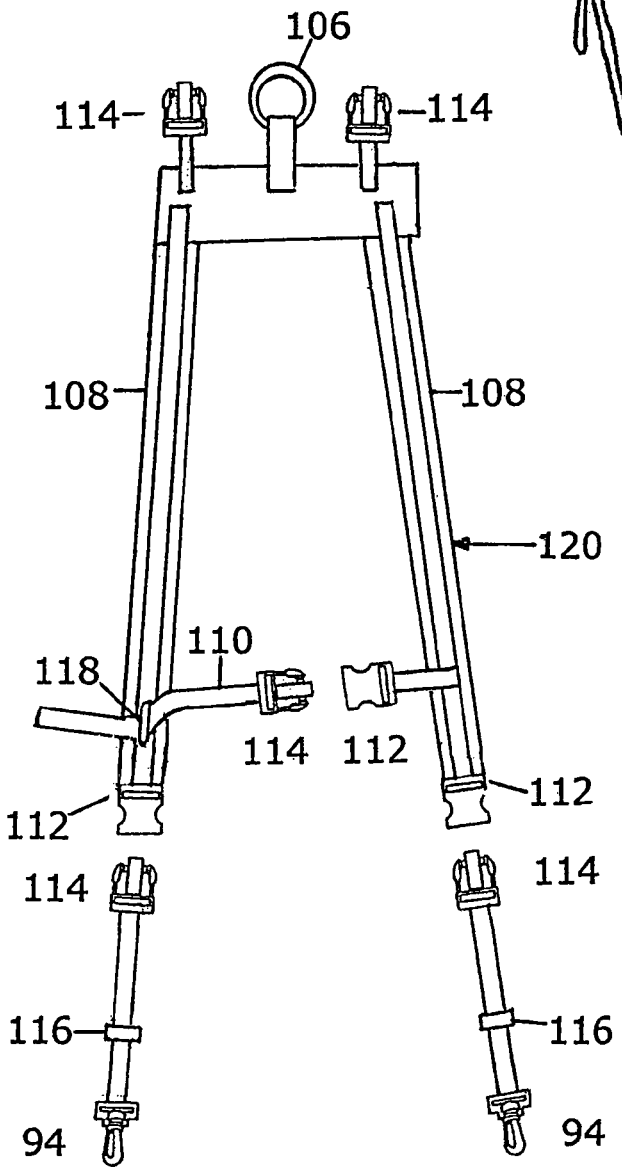
FIG. 21 shows view of detachable shoulder harness.

FIG. 21 illustrates shoulder harness 120. As shown in FIG. 11 in a detached mode harness 120 has auxiliary uses. The primary purpose of harness 120 is used for carrying chair 31 and/or backpack 122 in a comfortable manner on an individual's back. Male buckles 114 are connected to female buckles 56 shown in FIG. 5. Swivel spring clips 94 are attached to "D" rings 34 connected with back seat tube 38. Male buckles 114 allow the straps to be adjusted to different lengths. Strap 110 adjusts to fit across the chest area of an individual at a desired comfort level.

Figure 22:
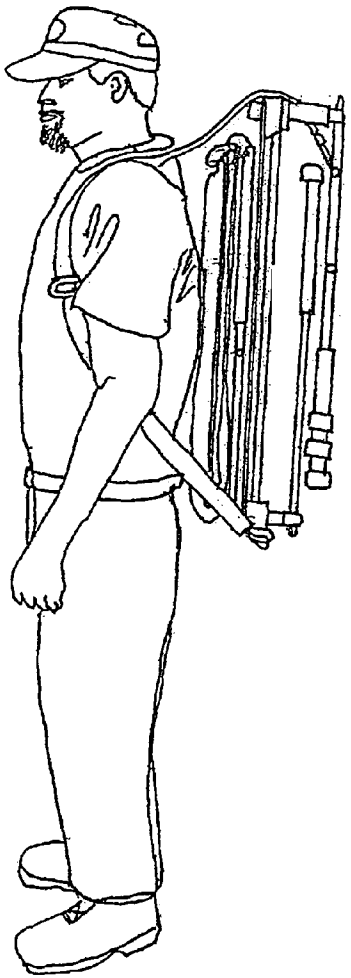
FIG. 22 is side view showing carrying method of folded chair.

FIGS. 22, 23 and 24 illustrate carrying positions of the folded chair 31 with backpack 122 and without.

Figure 3:
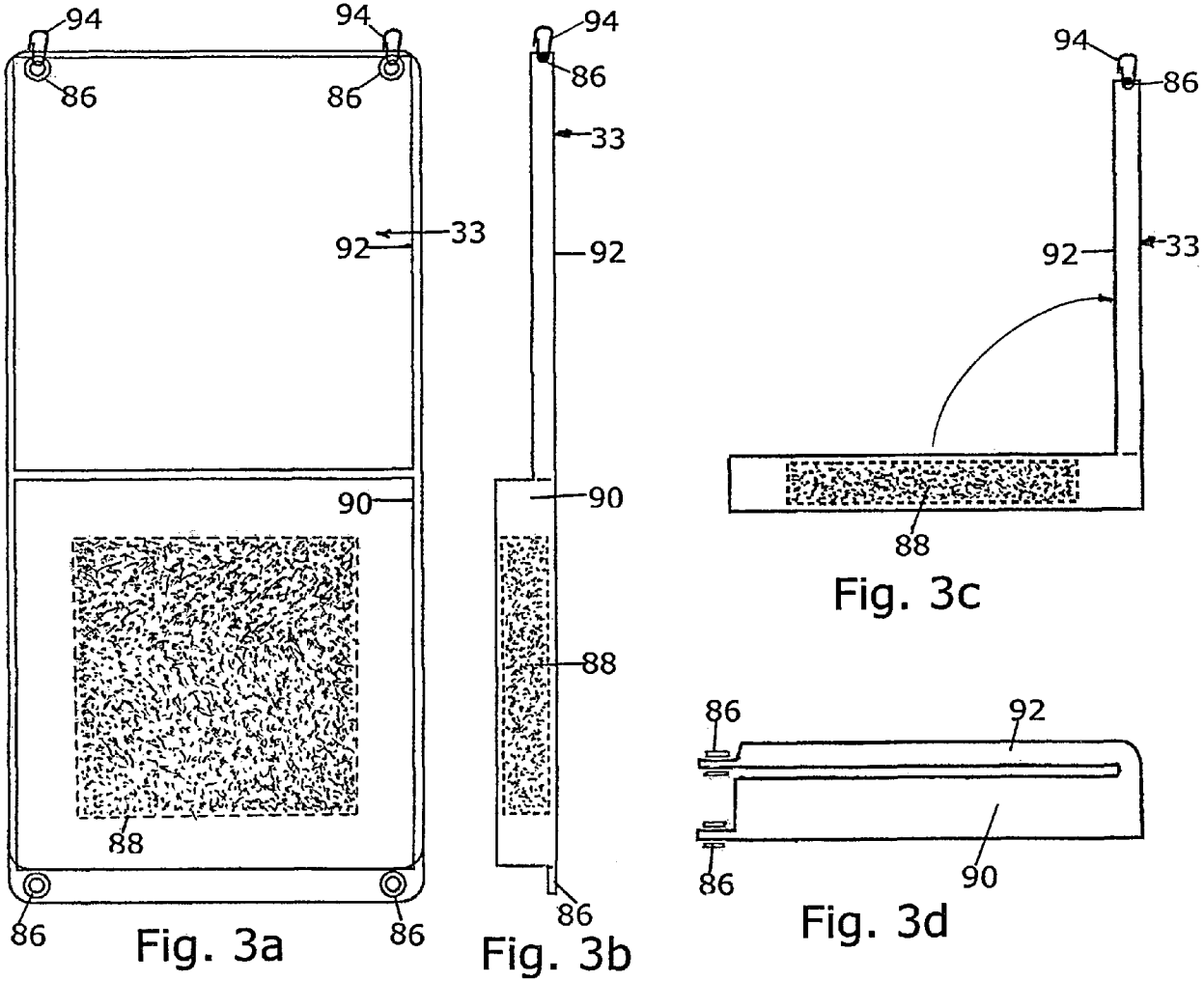
FIG. 3 shows front view of the combined padded seat and backrest FIG. 3*a*, side view FIG. 3*b*, side view of the backrest in an upright seated position FIG. 3*c*, and side view of the backrest and seat in a folded position 3*d*. The areas within the dashed lines hold a removable bag filled with heat producing material.

The use of chair 31 is accomplished in the following manner. Viewing FIGS. 2, 3, 5 and 6 chair 31 is in an open position. The user grabs the front end of cushion seat 33 and rotates upward to meet the backrest portion of 33. See FIG. 3*c* and FIG. 3*d*. Cushion seat 33 is now parallel with backrest framework 35, see FIGS. 2, 4, 5 and 6. User proceeds to grab the folded end of seat 33 and rotate 360° over the top of backrest 35 to a parallel position with the backside of backrest 35. The top end of cushion seat 33 remains attached to backrest 35 by means of spring clips 94 attached to grommets 86 and "D" rings 32. This allows the cushion seat 33 to hang in this position. The front end of armrests 68 are preferably removed by compressing button 102 and lifting upward until detached. The opposite ends remain attached on tubes 36 through a flexible canvas type material, same as the seat and backrest material. Armrests 68 are laid on the seat of chair 31. User proceeds to pull sleeves 48 upward allowing backrest 35 to rotate downward and forward by means of knee joints 70 to a parallel position with seat framework 41. See FIG. 6. Chair 31 should now be laid on its side. In this position user folds the back leg framework 37 by first releasing sleeve 84 on right and left leg by sliding sleeves 84 towards seat framework 41. User rotates legs towards seat framework 41. In like manner, front leg framework 39 is folded to seat framework 41. Chair 31 is now in compact position with cushion seat 33, backrest framework 35, seat framework 41 and leg frameworks 37 and 39 all parallel. It is important to fold back leg framework 37 before framework 39 because upper back leg tube 50 is shorter than upper front leg tube 52 which allows framework 37 to fold inside framework 39. It should also be noted that framework 39 is wider than framework 37 allowing the legs of 39 to close on the outside of legs of 37. At this point male buckle with strap 74 is wrapped around the above folded chair 31 unit and attached to female buckle with strap 72. This strap is tightened by pulling the strap through end of male buckle 74.

Referring to FIGS. 21 and 5 spring clips 94 remain attached to chair 31 at "D" rings 34 on back seat tube 38. The opposite end of harness 120 containing male buckles 114 and ring 106 are looped over tube 30 of backrest framework 35. This is a convenient location to keep this detached end of harness 120 while chair 31 is in use. Referring to FIGS. 21 and 5 with chair 31 in the folded and strapped position, unattached end of harness 120 is attached to female buckles 56 located on tube 30 of leg framework 39. Harness 120 is now mounted on user's back shown in FIG. 22.

Attaching backpack 122 FIG. 20 is accomplished by use of auxiliary adjustable straps. These straps are not shown. The straps are preferably black nylon material with spring clips 94 attached at each end. Adjustable means such as female buckle 112 and male buckle 114 are attached on the strap between clips 94. Other type straps can be used. These straps are passed through upper and lower attachment points of the carrying harness of backpack 122. Spring clips 94 of the one auxiliary strap are attached to "D" rings 32 at the upper point, and the other auxiliary strap is attached to "D" rings 34 on tube 38. Tightening each strap allows the backpack to remain in proper position. FIG. 24 illustrates the carrying position.

An additional embodiment used as a safety feature is a blaze-Orange canvas or nylon rectangular shaped cloth with grommets 86 on each corner. This can be attached to chair 31 in open position at "D" rings 32 and 34. When chair 31 is being transported, the cloth can be attached in like manner to "D" rings 32 and 34. This can be done with or without the backpack attached. Preferably mountain type connections such as carabineers are used but other means are also available. Blaze-orange is a color required while hunting deer or other game as a safety feature.

Material used for chair 31 requires a durable water resistant flexible cloth such as nylon. Connector blocks 58, 60, 76, 78 and 80 are preferably made of black nylon. Other similar machined or die molded materials can be substituted. The preferred method of attachments is by use of tension pins 100. Other means such as screws, nuts and bolts, adhesive, welds, or other devices can be used. Straps 56, 72 and 74 are preferable sewn in place. Gluing, riveting, screwing or other methods can be used. Because of strength, resistance to corrosion and light weight requirements, aluminum tubing is the preferred material used for support frameworks 35, 37, 38, 41, armrests 68, stabilizers 82, sleeves 48 and 84. Solid aluminum rod is preferably used for elbows 70, 96 and 124.

The primary usage of chair 31 is hunting; therefore the preferred color of cloth is camouflage with all other materials black. Other color combinations can be used depending on the desired usage of chair 31. Chair 31 can be used for many activities besides hunting such as hiking, picnicking, at parades, outdoor concerts, home etc.

Although the description above contains many specifications, these should not be construed as limiting the scope of the invention, but as merely providing illustrations of some of the presently preferred embodiments of this invention.

The scope of the invention should be determined by the appended claims and their legal equivalents, rather than by the examples given.

What is claimed is:

1. A compact folding portable chair comprising;

a rigid backrest framework having an upper member and opposed side members;

a rigid seat framework having a back member and opposed side members further perpendicularly connected to the top side of upper rear leg members at the back corners of said back member and said side members;

said seat framework side members at opposite ends of said back corners are further perpendicularly connected to upper front leg members parallel with said rear upper leg members;

said backrest framework is hingeably joined to said seat framework at the top side of said upper rear leg members and is rotatable between a folded position and an open position;

said backrest framework is locked in the open position by means of a sliding sleeve;

a lower rear leg rigid framework having opposed leg side members and upper and lower stabilizer members forming an H style framework;

said lower rear leg framework is hingeably joined to the bottom side of said rear upper leg members;

a lower front leg rigid framework having opposed leg side members and an upper and lower stabilizer members forming an H style framework;

said lower front leg framework is hingeably joined to the bottom side of said front upper leg members;

a pair of mid point hinged stabilizing members hinged at both ends and joined to the mid points of said seat side members and at the mid points of the left and right side of said lower front and lower rear leg members;

said mid point stabilizing members have sliding sleeves to lock said lower front and lower rear leg members in an open position;

a pair of removable rigid curved members connected to flexible material that form armrests with cup holders that are further joined with said upper front leg members at one end and said backrest side members at opposed ends;

said seat framework and said backrest framework is covered with the same said flexible material and connected with grommets at said upper front leg members and upper rear leg members;

said flexible material is further connected to the top of said backrest framework by means of an envelope style closure fitted over said backrest framework side members which forms the seating and backrest supporting areas;

an enclosure member consisting of an adjustable strap or expandable cord with hook, spring-clip or similar type attachment member on opposing ends which when attached at one end to the said upper stabilizing member of the said lower front leg framework and at the other end to said backrest framework will retain the said compact portable chair in a folded position.

2. The compact portable chair of claim 1 wherein said removable curved members are attached to the front end of said flexible material by means of the use of an envelope type opening in the said flexible material and made secure with rivet or screw;

said removable curved members are slightly larger than said upper front leg members allowing said curved members to fit over said upper front leg members;

said curved members have three positioning holes which align with a spring loaded button in said upper front leg members and when said buttons are depressed the said curved members may be repositioned or removed as desired.

3. The compact portable chair of claim 1 has:

four adjustable leg sleeves;

said adjustable leg sleeves have incrementally positioned holes;

said sleeves slide over said lower front and lower rear leg members;

each of said leg members is equipped with a spring loaded button which when depressed allows said sleeve to change positions;

releasing said button into a new sleeve hole will increase or decrease the length of said leg member and this feature allows each said leg member to individually adapt to the level of the contact surface.

4. The compact portable chair of claim 1 has an attachable cushioned seat and backrest which folds to a compact position at the fold of the said cushioned seat and backrest;

said cushioned seat and backrest has cushion type foam used in the furniture industry and said cushion foam is covered with a durable, water resistant, flexible material useable for outdoor activity;

said cushion seat and backrest has, in the seat area, a void section into which either a same size cut of said cushion foam maybe inserted or a same size cut of material which upon compressing is heat producing maybe inserted in the void area;

said heat producing material is covered with a cloth material in a separate enclosure which can be inserted in the said seat void area;

said same size cut of cushion foam or said heat producing material enclosure is inserted into said void area through an opening on the underside of said cushion seat and is closed by means of Velcro or other type closure;

said heat producing enclosure can be replaced with said same size cut cushion foam if desired for use during warmer climatic conditions;

said cushion seat and backrest is further equipped with grommets on the four corners for attachment to said chair;

said cushion seat and backrest can be flipped for use on either side;

said cushion seat and backrest is further used as a cushion between said compact portable chair and the back of the user carrying said compact portable chair.

5. The compact portable chair of claim 1 has:

a detachable carrying harness formed of parallel shoulders straps and horizontal strap and each of said shoulder straps and the said horizontal strap having an adjustable buckle consisting of a male section and a female section attached to each at near mid points of said straps;

said shoulder straps having spring clips on each of the opposed ends which are used to connect to "D" rings on said seat back member at opposed ends and the "D" rings of said lower front leg members;

said detachable carrying harness in a detachable mode can be used for transporting items using an attached drag strap or line which is attached to said detachable harness.

6. The compact portable chair of claim 1 has:

a backpack attached with upper and lower auxiliary straps connected by means of spring clips on each end of said auxiliary straps to the said "D" rings on said seat framework back member and "D" rings on said lower front leg members;

said upper auxiliary strap is looped through the upper attachment point of said backpack carrying straps and tightened by means of an adjustable buckle on said upper auxiliary strap which allows said backpack to be secured to said portable chair;

said lower auxiliary strap is looped through the lower attachment point of said backpack carrying straps and tightened by means of an adjustable buckle on said lower auxiliary strap which allows said backpack to be secured to said portable chair.

7. The compact portable chair of claim 6 whereby the detachability of said backpack allows said backpack to be placed at any location facilitating its use while seated on said portable compact chair;

said backpack can be used separately for transporting said backpack contents.

8. A method for folding and transporting a body support comprising;

a backrest support with frame, seat support with frame, back leg frame support, front leg frame support, a backpack, a pair of armrests with curved frames, a pair of auxiliary straps, a separate foam cushioned back and seat pad, and a pair of shoulder straps said method comprising steps of:

release buckles on auxillary straps holding backpack and remove backpack from folded compact chair of claim 1;

rotate backrest support frame upward 90 degrees and lock in place by sliding sleeves on backrest support frame downward;

rotate front leg frame 90 degrees outwardly and lock in place by sliding sleeves on leg support frame downward to stop position;

rotate back leg frame 90 degrees outwardly and lock in place by sliding sleeves on leg support frame downward to stop position;

place the chair on four legs and connect curved frame supports of armrests to front of seat support frame with the use of snap button retaining means;

rotate separate foam cushioned back and seat pad 360 degrees over the top of backrest support frame and unfold to fit in the backrest and seat area;

reverse the above procedure to return the chair to a portable conveyance.

* * * * *